United States Patent [19]

Paek et al.

[11] 4,175,925

[45] Nov. 27, 1979

[54] CHARCOAL-STARTER APPARATUS

[76] Inventors: Yongik Paek; Ardis I. Paek, both of 16841 Roque La., Huntington Beach, Calif. 92647

[21] Appl. No.: 970,201

[22] Filed: Dec. 18, 1978

[51] Int. Cl.[2] ..... C10L 11/08; C10L 11/00

[52] U.S. Cl. ..... 44/35; 44/38; 44/40; 126/25 B

[58] Field of Search ..... 44/35, 38, 40; 126/25 B

[56] References Cited

U.S. PATENT DOCUMENTS

| | | | |
|---|---|---|---|
| 2,212,157 | 8/1940 | Fernholtz | 44/38 |
| 2,622,017 | 12/1952 | Bramhall et al. | 44/40 |
| 2,738,260 | 3/1956 | Wolfson et al. | 44/40 |
| 3,374,071 | 3/1968 | Corriher, Jr. et al. | 44/38 |

FOREIGN PATENT DOCUMENTS

| | | | |
|---|---|---|---|
| 10519 | of 1911 | United Kingdom | 44/38 |

*Primary Examiner*—Carl F. Dees
*Attorney, Agent, or Firm*—Francis X. Lo Jacono

[57] ABSTRACT

A charcoal-starter apparatus that is a disposable, folding, charcoal-starting, bag-like container, wherein the bag-like container comprises a continuous upright wall structure, preferably having four sides composed of multilayers of thin aluminum foil sheets and a bottom wall formed from a burnable paper or suitable synthetic material, wherein a metal wire or ribbon is disposed about the upper open edge of the container to define a support structure, the upright wall structure being formed with an outer aluminum wall and an inner aluminum wall, wherein the inner aluminum wall defines a heat-reflective member that prevents the outer aluminum wall from being affected by the heat generated within the bag-like container, the side and bottom walls including a plurality of vent holes to allow a continuous flow of air to pass over the ignited charcoal members during the burning thereof. A kindling wick is attached to the top edge of the container and extends down to the bottom thereof, thus engaging the starting fuel whereby the charcoal briquets can be ignited by lighting the wick.

7 Claims, 7 Drawing Figures

FIG. 1
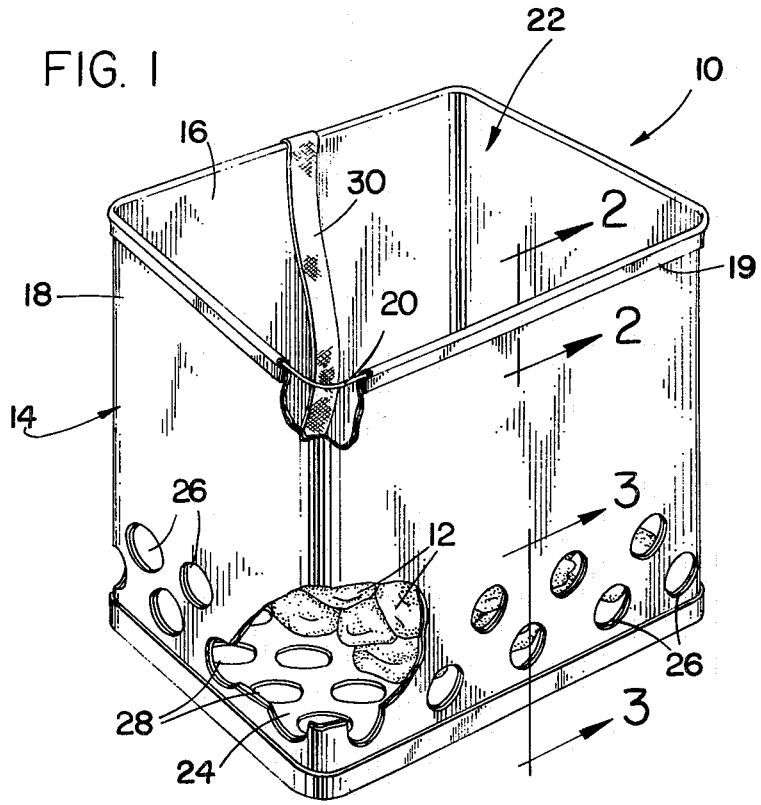
FIG. 2
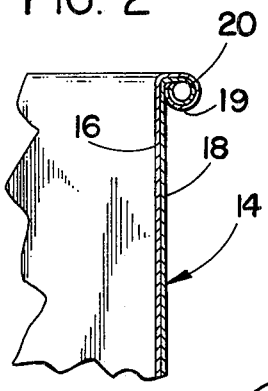
FIG. 3
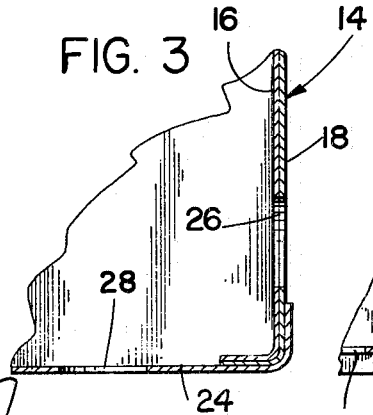
FIG.4
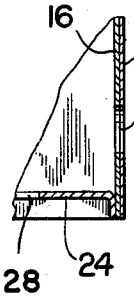
FIG. 7
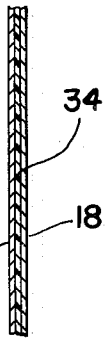
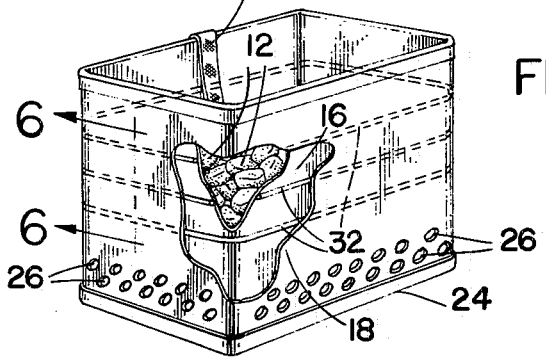
FIG. 5
FIG. 6
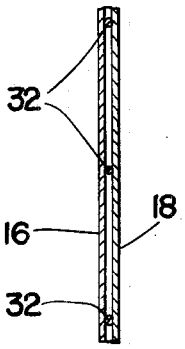

CHARCOAL-STARTER APPARATUS

BACKGROUND OF THE INVENTION

1. Field of the Invention

This invention relates generally to a fire-kindling device and, more particularly, to a disposable, bag-like container formed with a plurality of aluminum foil wall structures.

2. Description of the Prior Art

As is well known in the art, various problems and difficulties are encountered in providing suitable means for igniting solid fuels such as charcoal and/or charcoal briquets.

Several types of fire-kindling devices have been used and are in use at the present time. However, most of these devices have features that restrict their use, and do not provide reflective internal heat to sufficiently aid in the starting and kindling of the solid fuel disposed within the structure of the particular device. Also, often these devices are hazardous to use.

It is well established that in order to effectively ignite and kindle solid fuels, particularly the charcoal-briquet variety, the fuel should be held in a compact mass about the heat source and should be exposed to a direct flow of air. Most devices that attempt to provide the necessary requirements are made of packages that are very often completely consumed by the initial combustion—thereby preventing necessary internal heat from rising sufficiently to aid in the burning of the fuel.

Various methods and devices have been generated, as for example in U.S. Pat. No. 2,738,260 wherein the inner layer comprises a combustible material which does not protect the outer layer—whether it be incombustible material or not. The inner layer must reflect the heat into the fuel in order to protect the outer layer; otherwise, the outer layer will burn or melt.

Another type is disclosed in U.S. Pat. No. 3,010,809 wherein the device is designed to completely burn, having side walls which are totally comsummable.

Other such fire-kindling devices are disclosed in U.S. Pat. Nos. 2,212,157; 3,031,277; 3,269,807; and 3,374,071.

SUMMARY OF THE INVENTION

The present invention comprises a disposable charcoal starter apparatus wherein charcoal and similar fuels, such as briquets which are made from pulverized coal or compressed wood products, are disposed within a bag-like container, the container structure being formed from a multiplicity of non-flammable, thin, metal-foil sheets. It is well known that the above fuel types are very difficult to ignite with a match. Very often, it is necessary to use a starter fuel to aid in igniting the coals, the starter fuels generally being one of two types—a combustible solid-fuel package or a conbustible liquid.

However, it has been further established that, by massing the coals together, greater heat is generated—thus assisting the coals in igniting and causing them to burn evenly.

Accordingly, the present invention provides a simplified means whereby charcoal briquets can be prestacked in a disposable container, and whereby the container can allow a very high concentration of heat to be generated about the area of the coals—without the total destruction of the container in which the coals are quickly and uniformly ignited.

The present charcoal-starter apparatus comprises a foldable, disposable container defined by a continuous wall structure, generally having four side walls that are positioned in a vertical, upright configuration, when prepared for use.

In the preferred embodiment of the present invention, the container wall structure comprises an outer layer of aluminum foil and a slightly-spaced-apart, inner aluminum-foil member. Each member is secured at its upper free edge by a wire or metal band defining the upper opening area, providing a support structure whereby the open upper end of the container is held in place during the burning of the charcoals.

The lower ends of the walls are secured to a bottom flammable wall of a paper material or a like burnable element that allows the charcoals to be stored within the container before use. Further included in the lower portion of the wall structure is a plurality of vent holes that allow air to circulate up through the coals and the chimney-like structure. The bottom wall also includes vent holes, thus creating an even burning of the charcoals as they are ignited.

Various methods of igniting the coals can be employed; however, the present device includes an elongated wick member adapted to be readily burnable. The wick is attached to the upper wire-support member and extends downwardly, thus engaging the charcoals which have liquid fuel applied thereto; or the wick is connected to a suitable known solid fuel, as previously discussed.

It is important to stress that, with the arrangement of an inner and outer aluminum metal foil, a very high temperature can be created within the container as the charcoals are ignited. It has been found that, when ignition is started, the flames therefrom will burn the inner wall which acts as a protective inner lining. That is, the heat is reflected away from the outer aluminum wall; and, as the temperature rises in the closed area of the structure, the inner wall becomes a very thin skeleton like shield that prevents the continuing high temperature from reaching the outer aluminum wall.

Thus, the charcoals are allowed to burn evenly and faster while the outer wall is still standing. Once the coals are ready for use, the structure is readily removed—since the bottom wall has by this time been totally consumed.

Various other embodiments are contemplated using an inner and outer aluminum wall structure. One embodiment consists of metal walls laminated with a thin plastic vinyl sheet sandwiched therebetween to increase the overall strength of the structure.

Another embodiment would include a plurality of wire or ribbon bands disposed between each wall member, which will also provide additional support for the structure.

OBJECTS AND ADVANTAGES OF THE INVENTION

The present invention has for an important object to provide a charcoal-igniter device that is not fully consummable, wherein a first inner wall acts as a heat reflector for the second outer support wall, and wherein each wall consists of aluminum foil sheets having a closed bottom wall of consummable material such as heavy paper or the like.

It is another object of the invention to provide a charcoal-briquet-starter apparatus that is so constructed that it is strong enough to carry its own briquets therein.

It is still another object of the invention to provide a charcoal-starter apparatus that can be self-supporting so as to define a flue-like chimney, whereby a very high temperature can be sustained therein to establish quick ignition and a fast, even burning of the charcoal.

It is further an object object of the invention to provide a charcoal starter of this type that is relatively inexpensive to manufacture.

Still a further object of the invention is to provide an apparatus of this character that is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

DESCRIPTION OF THE DRAWINGS

Referring more particularly to the accompanying drawings, which are for illustrative purposes only:

FIG. 1 is a perspective view of the present invention shown in an open mode with portions thereof broken away for clarity;

FIG. 2 is an enlarged cross-sectional view taken substantially along line 2—2 of FIG. 1 illustrating the upper support wire member positioned around the open free edge of the upright walls;

FIG. 3 is an enlarged cross-sectional view taken substantially along line 3—3 of FIG. 1 showing the vent holes and construction of the bottom wall;

FIG. 4 is a view similar to that of FIG. 3 illustrating an alternative arrangement of the bottom wall;

FIG. 5 is a perspective view of an alternative arrangement of the construction of the apparatus;

FIG. 6 is an enlarged cross-sectional view taken along line 6—6 of FIG. 5; and

FIG. 7 is a cross-section similar to FIG. 6 showing the side walls having a thin plastic sheet interposed between the inner and outer metal walls.

DESCRIPTION OF THE PREFERRED EMBODIMENT

Referring more particularly to FIG. 1, there is shown a charcoal-starter apparatus defined by a container-like bag, generally indicated at 10. The container is illustrated herein as being in an open mode and ready for use. However, it should be understood that the container 10 is foldable; and it is contemplated that the container will be presented in a folded or closed form and will have a sufficient number of charcoals 12 stored therein. The charcoals will be pre-impregnated with a lighter fluid of a known suitable type; or there can be included a suitable solid-fuel package which is also well known (not shown).

The embodiment as illustrated in FIGS. 1, 2 and 3 comprises container 10 formed having a continuous four-sided wall structure, indicated generally at 14. The wall structure 14 may be formed as a cylindrical container as well, wherein said wall structure is formed having a first inner wall 16 and a second outer wall member 18. It is contemplated that each wall member will consist of a very thin sheet of metal foil, preferably aluminum foil which is inexpensive and readily available. The aluminum walls are placed in a side-by-side relationship to each other and are not necessarily fixed to each other in this embodiment.

When in an operating mode as indicated in FIG. 1, the container 10 is positioned in such a manner that walls 16 and 18 are placed in an upright vertical position with an upper open end defined by the free edges 19 of said wall, and wherein a flexible wire or metal ribbon 20 is secured about said free edges 19, as seen in FIGS. 1 and 2. In FIG. 1, the peripheral free edges 19 are overlapping wire 20; while in FIG. 2, wire 20 is shown as being fully wrapped by the peripheral edges 19. Thus, it can be seen that various methods of securing wire 20 can be employed to provide a firm definable opening 22 whereby a chimney like flue is established.

The lower end of walls 16 and 18 are attached to a bottom support wall 24, as seen in FIG. 3, wherein bottom wall 24 extends over the bottom edges of wall 18 and consists of a paper material or other suitable combustible material capable of carrying a load.

An alternative arrangement of bottom wall 24 is also shown in FIG. 4 wherein said bottom wall is attached to the inner wall 16. Thus, an ample supply of charcoals 12 can be stored within the defined container 10, said container being structurally capable of supporting said charcoals.

Disposed about the lower area of walls 16 and 18 are a plurality of vent holes 26 that allow air to flow through the charcoals and up the flue-like structure. Additional vent holes 28 are formed in the bottom combustible wall 24.

When the charcoal briquets are to be lit, a match is applied to a fire-starter means defined by a starter-wick member 30, as shown in FIG. 1. This wick member is made of a suitable flammable material that is attached at one end to wire 20, the other end thereof projecting downwardly to engage directly with charcoals 12 or a solid-fuel means, whereby the wick—when lit—will ignite fluid-impregnated charcoals or other fuel starter means of any well-known type.

Once the fire is flaming, heat is generated within the container; and as the flames and rising temperature increase, the inner aluminum foil wall 16 acts as a reflective means and protects the outer structural wall 18. Further, however, it has been found that the inner wall—due to the very high temperature generated therein—will take a skeleton-like formation. This formation, in itself, additionally reflects the high temperatures and thus protects the outer structural wall, whereby outer wall 18 is not affected by the flames or heat, and further allows the charcoals to reach the desired burning condition, whereupon the entire structure can then be removed from the burning charcoals.

It should be understood that bottom wall 24 is totally consumed, thus allowing the remaining structure to be removed from the coals. Since, the present apparatus is not totally consummable as with those known in the present art, the coals can remain within the container as long as it is necessary to allow all of the coals therein to burn evenly and create sufficient heat.

In FIGS. 5 and 6, there is shown an additional embodiment of the construction of the container, wherein there is provided additional means for supporting the side walls 16 and 18 during and after the ignition of the coals.

In this embodiment, additional wires 32 are provided that—as with wire 20—are capable of withstanding temperatures up to at least 1000° C. Wires 32 are shown positioned horizontally about the container, and interposed between the inner and outer walls 16 and 18 (See FIG. 6). It should be noted that an additional vertical wire can be incorporated therein as well, if the container is of a large enough size to require additional structural support for the side walls.

Referring now to FIG. 7, there is shown another arrangement of the side-wall construction, wherein a thin sheet of vinyl 34 is interposed between the inner aluminum foil wall 16 and the outer aluminum foil wall 18. This structural arrangement will also provide additional strength to the vertically arranged walls.

The invention and its attendant advantages will be understood from the foregoing description, and it will be apparent that various changes may be made in the form, construction and arrangement of the parts of the invention without departing from the spirit and scope thereor or sacrificing its material advantages, the arrangement hereinbefore described being merely by way of example; and I do not wish to be restricted to the specific form shown or uses mentioned, except as defined in the accompanying claims.

We claim:

1. A fire-starter apparatus for charcoal briquets and like combustible materials, wherein the apparatus comprises:

a disposable bag-like container formed having a first inner, vertical, upright wall structure, and a second outer, vertical, upright wall structure, wherein each wall structure is formed from a non-combustible material of thin metal foil;

a chimney flue defined by said inner and outer wall structures wherein the upper end thereof defines an opening;

a bottom wall member secured to said vertical wall structures, said bottom wall member being formed from a combustible material so as to be consumed during the ignition of said charcoals;

a plurality of air vents disposed about the lower portion of said wall structures, and additional air vents disposed in said bottom wall member, to provide air flow through said chimney flue;

means mounted to said wall structure to support said wall structure in a vertical position; and fire-starter means secured to said upper portion of said container, and arranged to engage and ignite said charcoal or an igniting fuel.

2. A fire-starter apparatus as recited in claim 1, wherein said wall-structure-support means comprises a flexible wire member secured about the peripheral opening of said container to establish said opening therein.

3. A fire-starter apparatus as recited in claim 2, wherein said inner and outer walls consist of an aluminum metal foil wherein the inner walls define a heat-reflective means to retain the heat within the burning charcoal area and to protect the outer wall from damage.

4. A fire-starter apparatus as recited in claim 3, wherein said inner aluminum foil wall establishes a reflective sheet, and wherein said reflective sheet is affected by the high temperature in said container, causing said inner aluminum sheet to be transformed into a skeleton-like partition capable of reflecting sufficient heat to prevent damage to the outer aluminum foil wall, said skeleton-like inner aluminum sheet being supported by said flexible wire.

5. A fire-starter apparatus as recited in claim 4, wherein said fire-starter means comprises an elongated wick member made of combustible material that is capable of being ignited by a match.

6. A fire-starter apparatus as recited in claim 5, wherein said container includes a plurality of wire-support members interposed between the inner and outer wall structures, whereby additional support for said container is provided.

7. A fire-starter apparatus as recited in claim 5, wherein said wall structure includes a thin sheet of plastic material interposed between said inner and outer wall structures to provide additional structural support thereto.

* * * * *